US011181122B2

(12) United States Patent
Anschütz et al.

(10) Patent No.: US 11,181,122 B2
(45) Date of Patent: Nov. 23, 2021

(54) FAN DEVICE

(71) Applicant: Nicotra Gebhardt GmbH, Waldenburg (DE)

(72) Inventors: Johannes Anschütz, Heidelberg (DE); Daniel Schultz, Schwäbisch Hall (DE)

(73) Assignee: NICOTRA GEBHARDT GMBH, Waldenburg (DE)

( * ) Notice: Subject to any disclaimer, the term of this patent is extended or adjusted under 35 U.S.C. 154(b) by 0 days.

(21) Appl. No.: 16/897,832

(22) Filed: Jun. 10, 2020

(65) Prior Publication Data

US 2020/0392966 A1 Dec. 17, 2020

(30) Foreign Application Priority Data

Jun. 11, 2019 (DE) ..... 10 2019 208 437.0

(51) Int. Cl.

| | |
|---|---|
| ***F04D 29/42*** | (2006.01) |
| ***F04D 29/28*** | (2006.01) |
| *F04D 17/16* | (2006.01) |
| *F04D 29/30* | (2006.01) |
| *F24F 3/167* | (2021.01) |

(52) U.S. Cl.

CPC ..... *F04D 29/4226* (2013.01); *F04D 29/281* (2013.01); *F04D 29/288* (2013.01); *F04D 17/16* (2013.01); *F04D 29/30* (2013.01); *F05D 2250/52* (2013.01); *F24F 3/167* (2021.01)

(58) Field of Classification Search

CPC .... F04D 29/281; F04D 29/30; F04D 29/4226; F04D 29/4246; F05D 2250/52

See application file for complete search history.

(56) References Cited

U.S. PATENT DOCUMENTS 2,330,938 A * 10/1943 Williams ..... F04D 29/4246 415/208.3
3,211,360 A * 10/1965 Lyman ..... F04D 29/441 417/423.14
3,950,112 A * 4/1976 Crump ..... F04D 25/166 415/206

(Continued)

FOREIGN PATENT DOCUMENTS

DE 3513902 A1 10/1985
DE 102005062523 A1 6/2007
DE 102006012356 A1 9/2007

(Continued)

*Primary Examiner* — Ninh H. Nguyen
(74) *Attorney, Agent, or Firm* — Hoffmann & Baron, LLP

(57) ABSTRACT

A fan device with at least one radial fan (12), with a fan housing (13) in which an impeller (14) which is rotationally driven about a rotation axis is arranged, wherein the fan housing has a guide wall (18) which extends in a circumferential direction (17) of the impeller (14) around this, is equipped with several arcuate wall sections and delimits air blow-out openings (19*a-d*), wherein an arcuate wall section of the guide wall (18) is assigned to each of the air blow-out openings (19*a-d*), wherein the fan housing (13) includes a front cover plate (20*b*) which is provided with an air suction opening (21), and a rear cover plate (20*a*) which with regard to the flow direction is arranged downstream of the front cover plate (20*b*), and wherein a frame-shaped peripheral wall (36) of an outer housing (35) is arranged around the guide wall (18) and at its rear side (37) includes a rear frame opening (38*a*).

17 Claims, 8 Drawing Sheets

(56) References Cited

U.S. PATENT DOCUMENTS 5,803,721 A * 9/1998 Lee ..... F04D 29/281
417/423.14
6,030,186 A 2/2000 Tang

FOREIGN PATENT DOCUMENTS

DE 102015226575 A1 6/2017
WO 2020015800 A1 1/2020

* cited by examiner

FAN DEVICE

BACKGROUND OF THE INVENTION

The invention relates to a fan device with at least one radial fan, with a fan housing in which an impeller which is rotationally driven about a rotation axis is arranged, wherein the fan housing comprises a guide wall which extends in a circumferential direction of the impeller around this, is equipped with several arcuate wall sections and delimits air blow-out openings, wherein an arcuate wall section of the guide wall is assigned to each of the air blow-out openings, wherein the fan housing comprises a front cover plate which is provided with an air suction opening, and a rear cover plate which with regard to the flow direction is arranged downstream of the front cover plate, and wherein a frame-shaped peripheral wall of an outer housing is arranged around the guide wall and at its rear side comprises a rear frame opening, said rear frame opening being arranged in front of the rear cover plate and serving as an exit opening, and at its front side comprises a front frame opening.

Radial fans can basically be classified into two different categories: the one group forms radial fans with a spiral housing and the other group forms free-running radial fans.

The spiral housing of the radial fans from the first group is to fulfil two tasks. It collects the air which flows out of the impeller, leads it to a common exit and converts a part of the speed energy (dynamic pressure) into pressure energy (static pressure) by way of the continuous widening of the cross section in the flow direction (diffuser effect). In the case of free-running radial fans, the air in the impeller is deflected in the radial direction and flows out there at the blade exit diameter. Diffusers, concerning which the cover disc and base disc of the impeller comprise outer edge regions which project beyond the blade exit diameter are known for increasing the static efficiency.

A fan device of the initially mentioned type is known for example from DE 10 2015 226 575 A1. The fan device comprises a fan housing, in which an impeller is rotationally driven about a rotation axis. The fan housing comprises a guide wall which extends spirally around the impeller in a circumferential direction of this. The guide wall comprises guide wall segments which are designed in a spiral-shaped manner and each merge into an individual air blow-out opening in a manner such that the fan housing comprises a plurality of air blow-out openings which are arranged distributed in the circumferential direction of the impeller. It is further disclosed to insert the radial fan into an air conditioning housing, for example an air-conditioning box or air-conditioning duct, in a manner such that an outflow zone is formed between the air blow-out openings and at least one assigned air-conditioning wall of the air-conditioning housing.

SUMMARY OF THE INVENTION

It is the object of the invention to provide a fan device of the initially mentioned type which is constructed in a simple manner, makes do with few components and is therefore inexpensively manufacturable. Furthermore, the advantages of free-running radial fans are to be combined with the acting manner of classical housing fans.

This object is achieved by a fan device with the features of the independent claim 1. Further developments of the invention are specified in the dependent claims.

The fan device according to the invention is characterised in that the front cover plate of the fan housing simultaneously forms a front terminating wall of the outer housing which projects beyond around the guide wall and with which the fan housing is fastened to the frame-shaped peripheral wall of the outer housing in the region of the front frame opening at the front side by way of fastening means.

The fan device according to the invention makes do with few components since in particular the front cover plate of the fan housing simultaneously forms the front termination wall of the outer housing. The fan housing can therefore be flanged onto the frame-like peripheral wall of the outer housing at the front side via the front cover plate. The assembly of such units can be carried out in a simple and relatively quick and thus inexpensive manner.

Concerning the fan device, it is the case of a directly driven radial fan with air guidance devices. The fan device according to the invention is suitable for example as a so-called filter-fan-unit for application in clean rooms.

Concerning a further development of the invention, the front and the rear frame opening have an essentially equally large opening cross section. By way of this, it is possible for the frame-like peripheral wall of the outer housing to be designed as a pure frame part, without face-side terminating walls.

In a particularly preferred manner, the front cover plate which forms the front terminating wall of the outer housing projects around and beyond the opening cross section of the front frame opening and is fastened to the front face edge of the frame-like or frame-shaped peripheral wall by way of fastening means. Herein, the frame-like peripheral wall can therefore serve as a type of flange, onto which the front cover plate is applied and fastened. With regard to the fastening means, these are preferably screw fastening means, in particular fastening screws and associated fastening holes on the one hand on the front cover plate and on the other hand on the face edge of the peripheral wall.

However, it would alternatively also be possible for the front cover plate to have an outline area which is smaller than the opening cross section of the front frame opening, and for an in particular peripheral contact web to be formed on the inner side of the frame-shaped peripheral wall, said contact web then serving for fastening the front cover plate.

With regard to a further development of the invention, the frame-shaped peripheral wall of the outer housing has a rectangular, in particularly square cross section. Basically however, it would also be possible for the frame-shaped peripheral wall to be designed as a cylinder.

With regard to a further development of the invention, the frame-shaped peripheral wall consists of several peripheral wall elements which are connected to one another by way of connection means. Preferably screw connection means serve as connection means, in particular fastening holes which correspond to one another and are formed on the peripheral wall elements, and associated fastening screws. Alternatively, it would also however be conceivable for the frame-shaped peripheral wall to be a single-piece component.

With regard to a further development of the invention, the front cover plate of the fan housing which forms the front terminating wall of the outer housing has a larger outline area than the rear cover plate of the fan housing, wherein the outline area of the rear cover plate is smaller than the cross section of the front frame opening to the extent that the radial fan with its fan housing as an assembly able to be handled as a unit is inserted with the rear cover plate in front into a receiving space which is laterally delimited by the frame-like peripheral wall. An outline area in the context of the application is to be understood as the area which is spanned by the outline of the respective component, thus in particular of the cover plate.

With regard to a further development of the invention, the front cover plate comprises at least one carrier grip. Herewith, the fan housing which is designed as an assembly which can be handled as a unit can be transported and inserted into the receiving space in a simple manner Usefully, four carrier grips which are assigned to the respective corners of the front cover plate are formed.

Concerning a further development of the invention, the guide wall is fastened on the one hand to the front cover plate and on the other hand to the rear cover plate by way of guide wall fastening means. The guide wall fastening means are usefully designed as screw fastening means, with fastening holes which are formed on the guide wall and with corresponding fastening holes on the one hand on the front cover plate and on the other hand on the rear cover plate, and with associated fastening screws.

Concerning a further development of the invention, the guide wall is constructed from several guide wall elements which form the arcuate wall sections and which are designed as separate components.

In a particularly preferably manner, the guide wall elements each comprise an arcuately bent base section and web-shaped fastening sections which are arranged on the longitudinal edges of the base section, lie opposite one another and each extend in the plane of the cover plates, for fastening to the assigned cover plate. The base section of the guide wall element is preferably arranged with respect to the exit cross section of the impeller in a manner such that the air which is blown out radially is led spirally to the assigned air blow-out openings.

In a particularly preferred manner, front face-side ends of the base section of the guide wall element together with the rear face-side ends of the adjacent guide wall element form lateral delimitations for the air blow-out openings. The upper and lower delimitations for the air blow-out openings then form the rear and the front cover plate.

It is possible for the front face-side ends of the base sections of the guide wall elements to comprise a terminating section which is bent over with respect to the remainder of the base section.

Concerning a further development of the invention, the web-like fastening sections which are assigned to the front cover plate are fastened to the inner side of the front cover plate in a direct manner or indirectly by way of an intermediately arranged fastening plate, on which on the one hand the fastening sections are fastened and which on the other hand is fastened to the inner side of the front cover plate.

It is possible that of the air blow-out openings, at least two, in particular four lie diametrically opposite with regard to the rotation axis of the impeller.

In a particularly preferred manner, the air blow-out openings each comprise a mouth area which is directed at an angle, in particular at an angle <90° to an assigned side edge of the front cover plate.

In a particularly preferred manner, a fastening interface for fastening a filter element is formed in the region of the rear face-side end of the frame-like peripheral wall.

Concerning a further development of the invention, a filter element is fastened to the fastening interface.

BRIEF DESCRIPTION OF THE DRAWINGS

A preferred embodiment example of the invention is represented in the drawing and is hereinafter explained on more detail. In the drawing are shown in.

DETAILED DESCRIPTION

Figure 1:
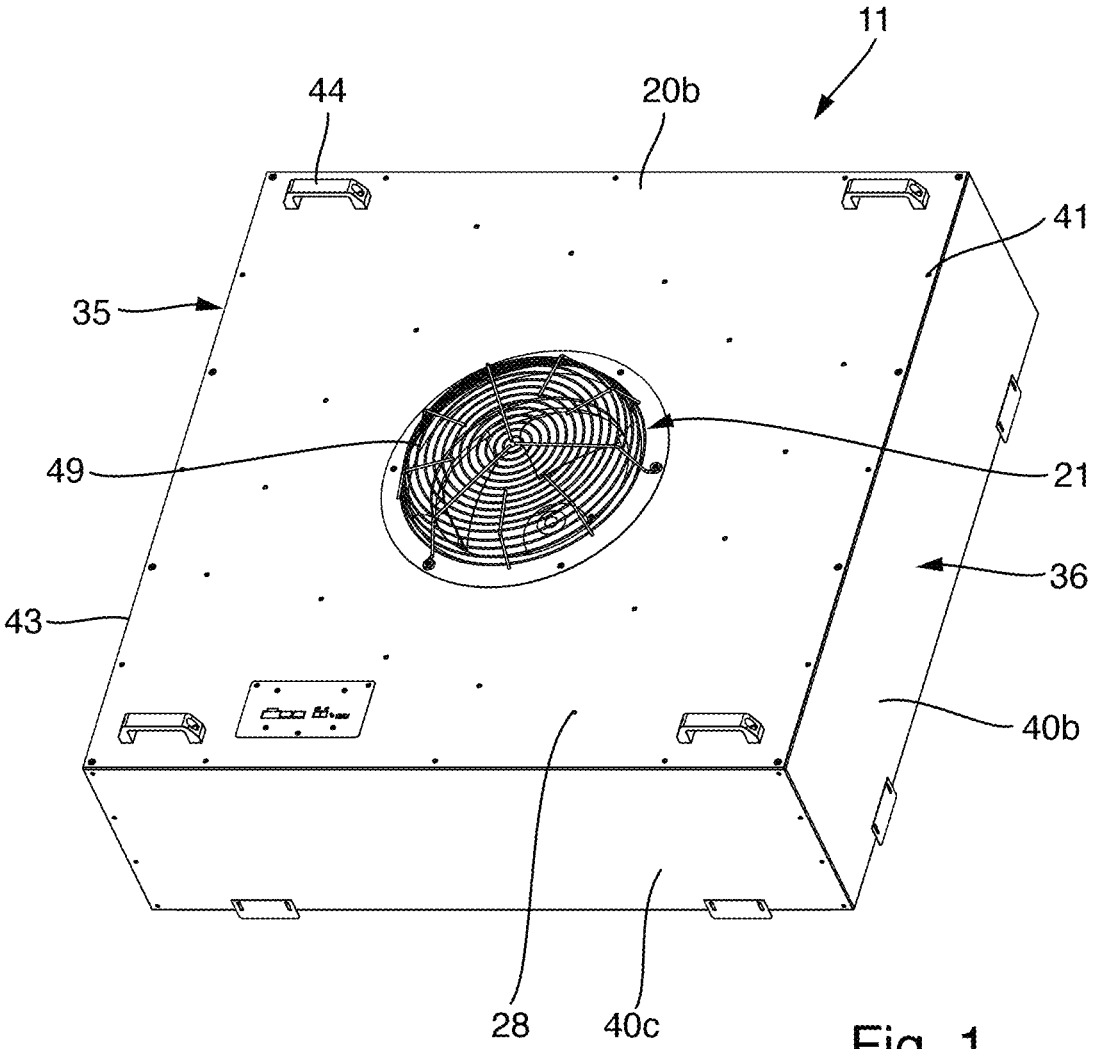
FIG. 1 a perspective representation of a preferred embodiment example of the fan device according to the invention, FIG. 2 a plan view of the fan device of FIG. 2, FIG. 3 a section through the fan device of FIG. 2 along the line of FIG. 2, FIG. 4 a perspective representation of the frame-like peripheral wall of the fan device according to the invention, FIG. 5 a perspective, schematic representation of the assembly which can be handled as a unit, in the form of a fan housing, FIG. 6 a perspective representation of the fan device according to the invention of FIG. 1 without the front terminating wall and with a view onto the fan housing, FIG. 7 a perspective representation of a guide wall element and FIG. 8 a perspective representation, partly sectioned, onto the fan device, with a view onto the guide wall segments of the fan housing.

FIGS. 1 to 8 show a preferred embodiment example of the fan device 11 according to the invention. Such a fan device is suitable for application in air-conditioning and ventilation technology, wherein here it is particular the field of application of clean rooms which should be mentioned. In semi-conductor manufacture, but also in the field of pharmaceutics, there exists the need for the protection of production processes from contamination in the form of particles, aerosols or the like. Clean rooms are conceived for such and these ensure that a certain particle number per cubic metre of air is not exceeded. As a rule, such clean rooms are conceived such that a multitude of so-called filter fan units are arranged on a clean room ceiling grid, by which means it is possible to create a so-called laminar flow, which is to say that the air which flows out of the filter fan unit exits in the form of a laminar flow, by which means in contrast to a turbulent flow the swirling of particles is prevented.

The fan device 11 according to the invention is therefore in particular suitable for such clean rooms and can therefore be applied there as a filter fan unit. However, it is of course possible for the fan device 11 according to the invention to also be applied in other fields in air- conditioning and ventilation technology.

However, the fan device is hereinafter extpained with its application in the form of a filter fan unit.

An important consitituent of the fan device 11 is a radial fan 12 which comprises a fan housing 13, in which an impeller 14 which is driven about a rotation axis is arranged.

The fan 14 comprises a blade ring 15 which consists of several blades 16 which for example can be inclined from the inside to the outside counter to the running direction, in particular designed in an arcuately bent manner or alternatively with a straight course.

As is particularly shown in FIGS. 5 to 8, the fan housing 13 comprises a guide wall 18 which extends in a circumferential direction 17 of the impeller 14 around this, is equipped with several arcuate wall sections and delimits air blow-out openings 19*a-d*, wherein an arcuate wall section of the guide wall 18 is assigned to each of the air blow-out openings 19*a-d*. The fan housing 13 further comprises a rear cover pate 20*a* and a front cover plate 20*b* which is provided with an air suction opening 21.

Figure 7:
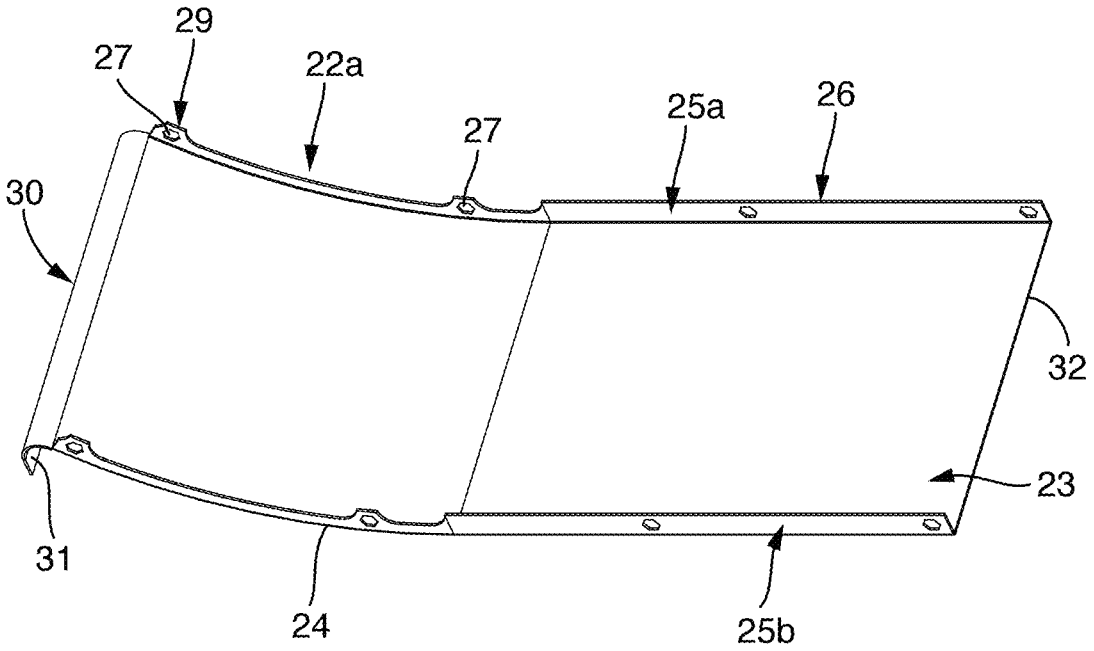
Figure 8:
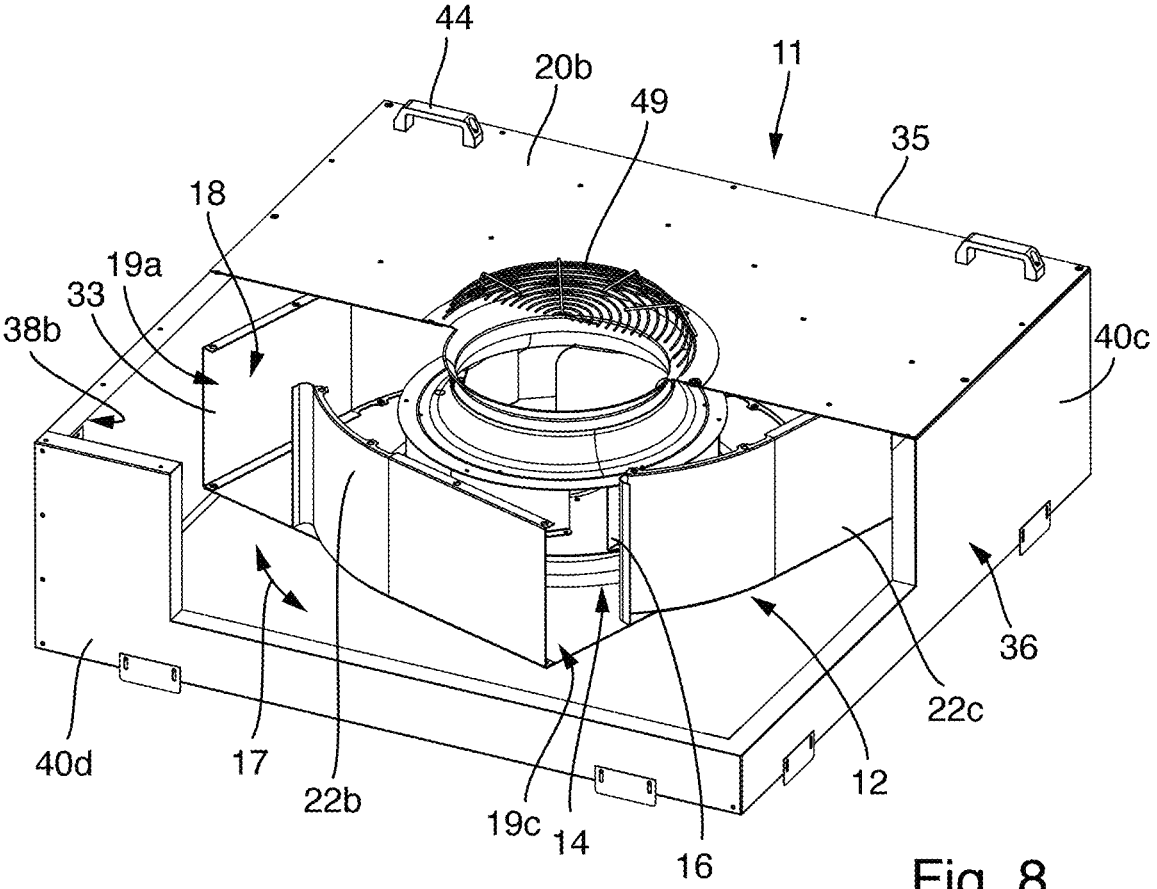

It is particularly evident on viewing FIGS. 7 and 8 together, the guide wall 18 is constructed of several guide wall elements 22*a-d* which form the arcuate wail sections and are designed as separate components.

Such a guide wall element 22*a-d* is shown by way of example in FIG. 7. The guide wall elements 22*a-d* each have an arcuately bent base section 23 and web-like fastening sections 25*a*, 25*b* for fastening to the assigned cover plate 20*a*, 20*b*, said fastening sections being arranged on the longitudinal edges 24 of the base section 23, lying opposite one another and each extending in the plane of the cover plates 20*a*, 20*b*. The guide wall elements 22*a*, 22*b* are usefully bent sheet parts, in particular sheet metal parts. The fastening sections 25*a*, 25*b* can be connected to the base section as one piece and be formed by way of bending over an initially flatly lying base section. Furthermore, the curvature of the guide wall elements 22*a*, 22*b* can also be effected by way of bending.

In the shown example case, the fastening sections 25*a*, 25*b* each comprise two section regions, of which a first longitudinally extended section region 26 comprises two guide wall fastening holes 27 which interact with corresponding fastening holes 28 on the rear cover plate 20*a*, wherein fastening screws (not represented) which project through the guide wall fastening holes 27 and the fastening holes 28 on the front cover plate 20*a* ensure a fastening of the respective guide wall element 22*a-d* on the rear cover plate 20*a*. The fastening sections 25*a*, 25*b* each comprise yet a further, second section region 29 which in contrast to the first section regions which is longitudinally extended comprises for example a single guide wall fastening hole 27. The connection onto the rear cover plate 20*a* in the region of the second section region 29 is effected in the same manner as with the front first section region 26. The other fastening section 25*b* which is assigned to the front cover plate 20*b* is designed in the same manner as the first fastening section 25*a* and comprises a first section region 26 which is extended in a relatively long manner and on which two guide wall fastening holes 27 are located, and a further second section region 29 with for example an individual fastening hole 27.

As is particularly shown in FIG. 7, a respective guide wall element 22*a-d* at the front face-side end 30 of the base section 23 comprises a terminating section 31 which is bent over with respect to the remainder of the base section 23. The rear, face-side end 32 which is opposite to the front face-side end 30 is free of such a terminating section 31 and runs out in a plane manner.

Figure 6:
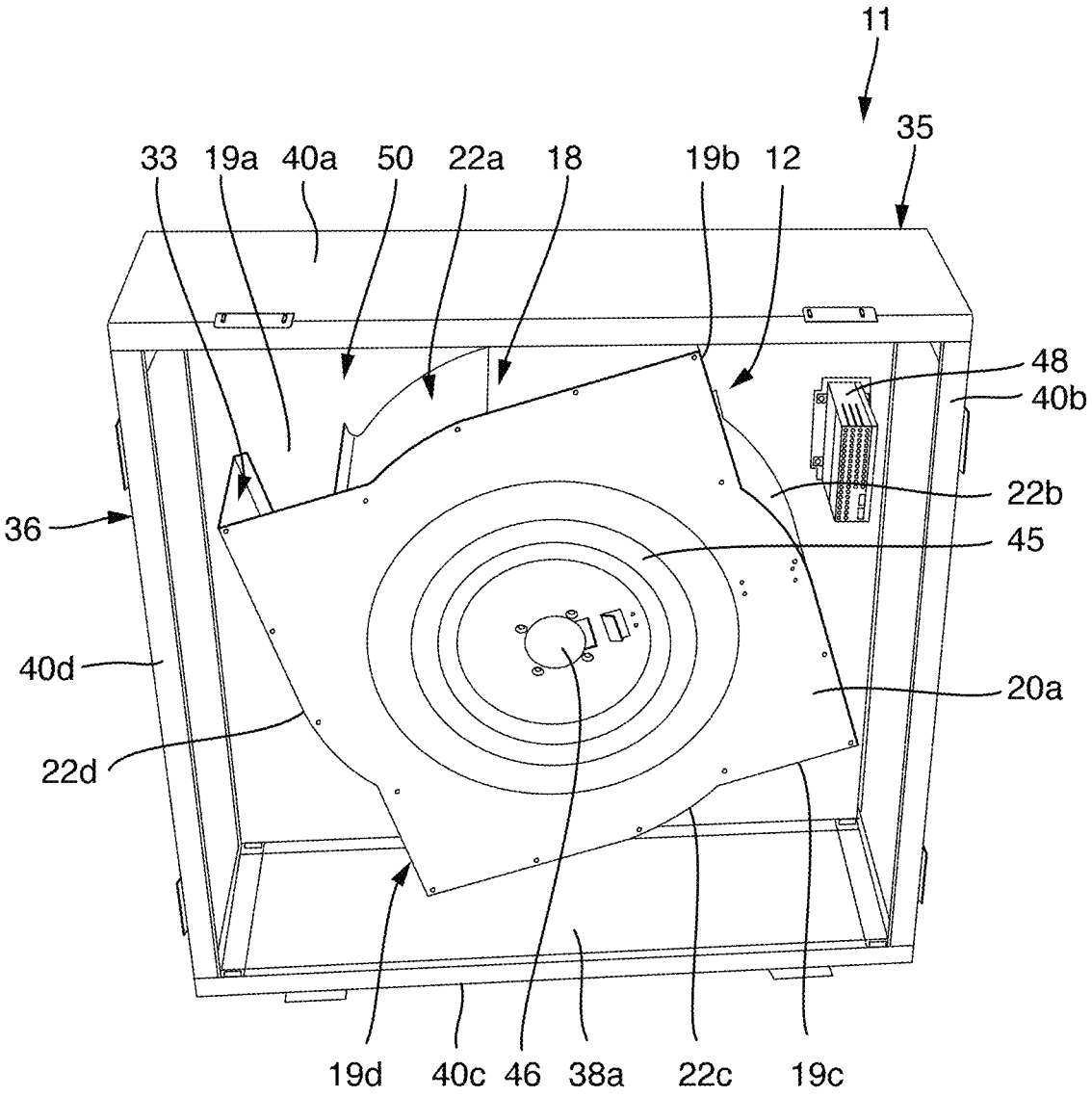

As is particularly shown in FIGS. 6 and 8, the fan housing 13 in the shown example comprises four air blow-out openings 19*a-d* which are each arranged at the corners of the fan housing 13. As is particularly shown in FIG. 8, front face-side ends 30 of the base section 23 of a guide wall element 22*a-d* together with rear face-side ends 32 of the adjacent guide wall element form lateral delimitations for the air blow-out openings 19*a-d*. The upper-side and lower-side delimitations for the air blow-out openings 19*a-d* are formed by the front and by the rear cover plate 20*a*, 20*b*. Thus four part-spirals are formed in the shown example case, and these each connect a part of the air which is deflected radially by the impeller 14 and feed it to the assigned air blow-out openings 19*a-d*. In the shown example case, the mouth areas 33 of the respective blow-out openings have a rectangular shape.

Figure 5:
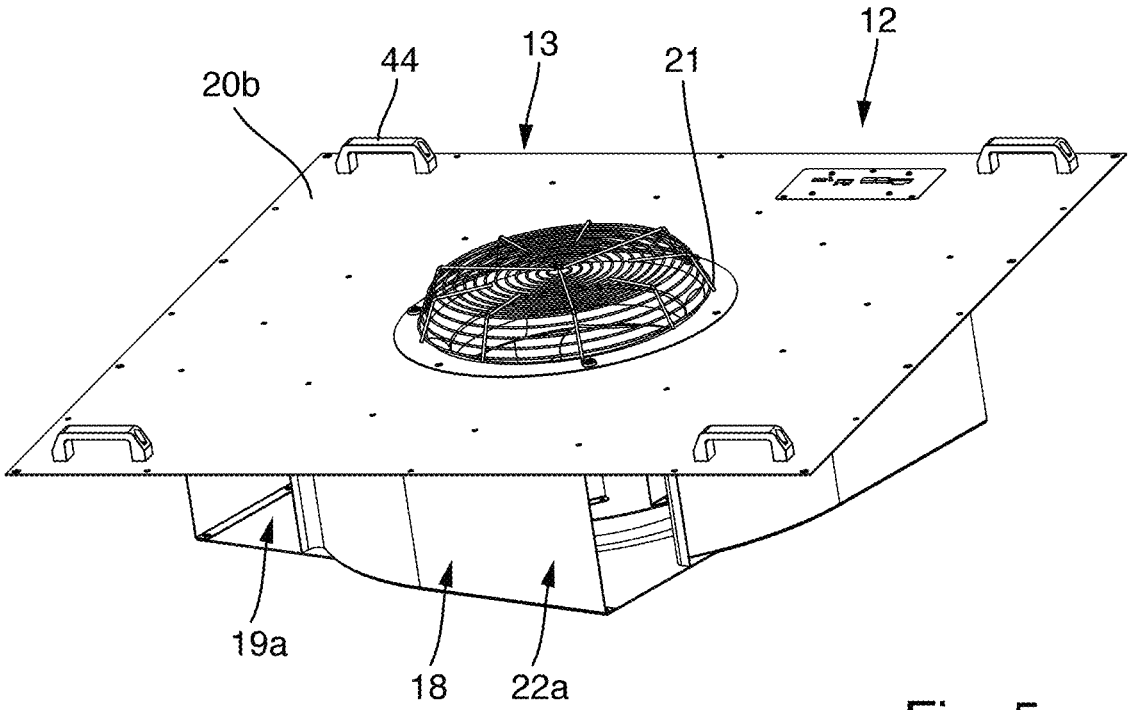

As is particularly shown on viewing FIGS. 5 and 8 together, the front cover plate 20*b* has a larger outline surface than the rear cover plate 20*a*, which leads to the advantages which are yet described hereinafter.

Apart from the radial fan 12 with its fan housing 13 and the impeller 14, a further significant constituent of the fan arrangement 11 is an outer housing 35 which is arranged around the guide wall 18. The outer housing 35 comprises a frame-shaped peripheral wall 36 which on its rear side 37 comprises a rear frame opening 38*a* which is arranged in front of the rear cover plate 20*a* and serves as an outflow opening, and at its front side 39 comprises a front frame opening 38*b*.

Figure 4:
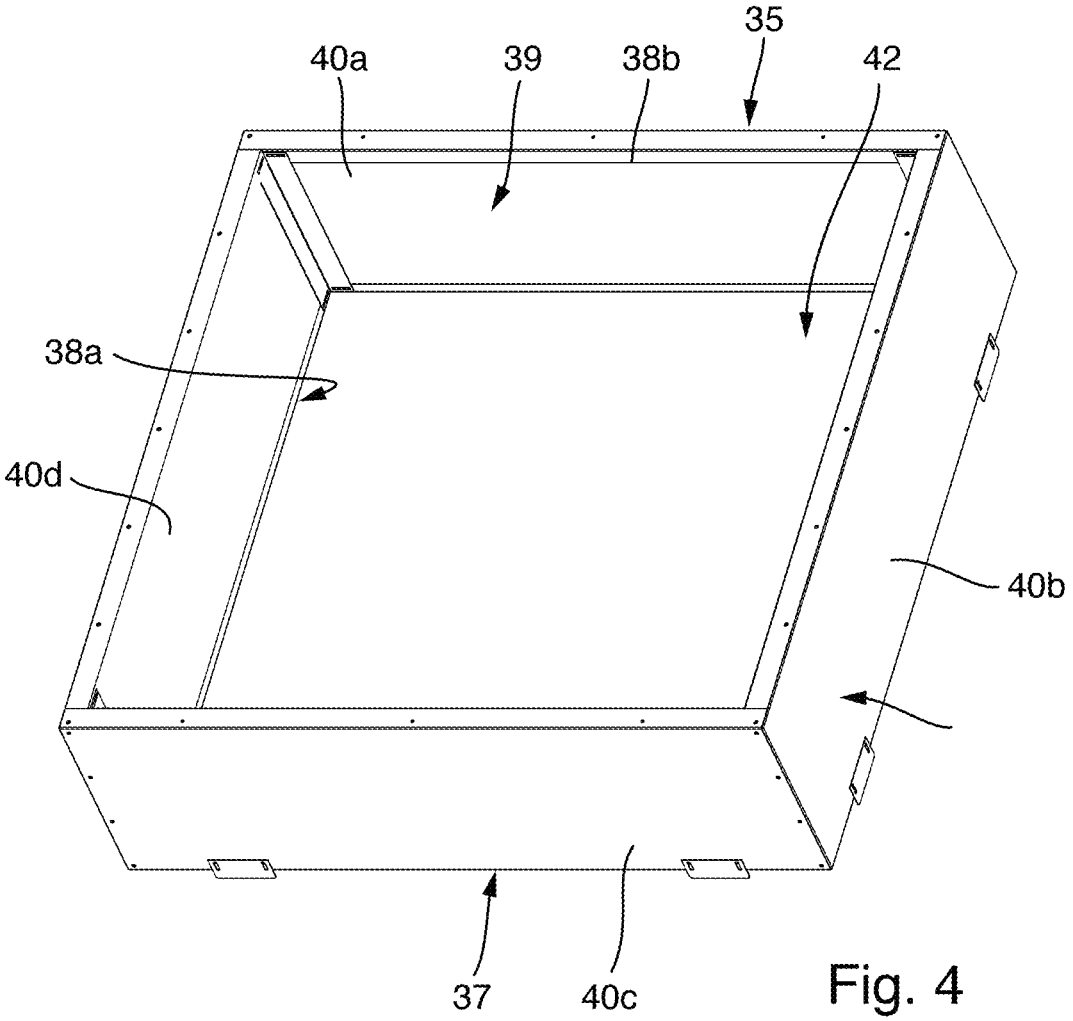

As is particularly shown in FIG. 4, the frame-shaped peripheral wall 36 in this example has a square cross section. In the shown example, the front and the rear frame opening 38*a*, 38*b* have an essentially equally large opening cross section.

In the shown example, the frame-shaped peripheral wall 36 consists of several peripheral wall elements 40*a-d* which are connected to one another by way of connection means. In the example case therefore four peripheral wall elements 40*a-d* are provided, these being equally long and at their joins being fastened to one another by way of the connection means, to which connection openings and associated connections screws belong.

A significant aspect of the invention is that the front cover plate 20*b* simultaneously forms a front terminating wall of the outer housing 35 which projects beyond and around the guide wall 18 and with which the fan housing 12 is fastened to the frame-shaped peripheral wall 36 of the outer housing 35 in the region of the front frame opening 38*b* at the rear side by way of fastening means 41.

The front cover plate 20*b* of the fan housing 13 which forms the front terminating wall has a larger outline area that the rear cover plate 20*a*, wherein the outline area of the rear cover plate 20*a* is smaller than the cross section of the front frame opening 38*b*, to the extent that the fan housing 12 as an assembly which can be handled as a unit is inserted with the rear cover plate 20*a* in front into a receiving space 42 which is delimited laterally by the frame-like peripheral wall 36.

Figure 2:
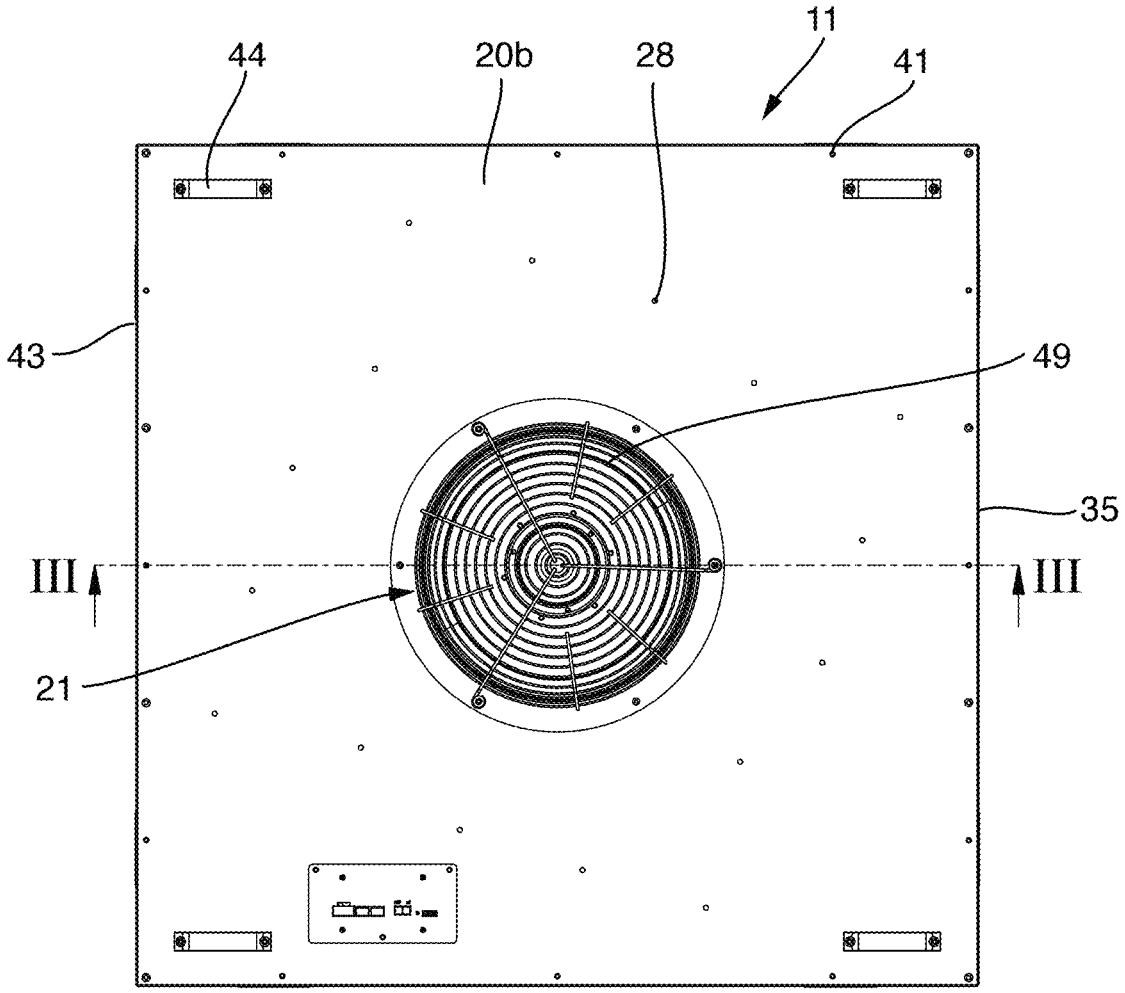
Figure 3:
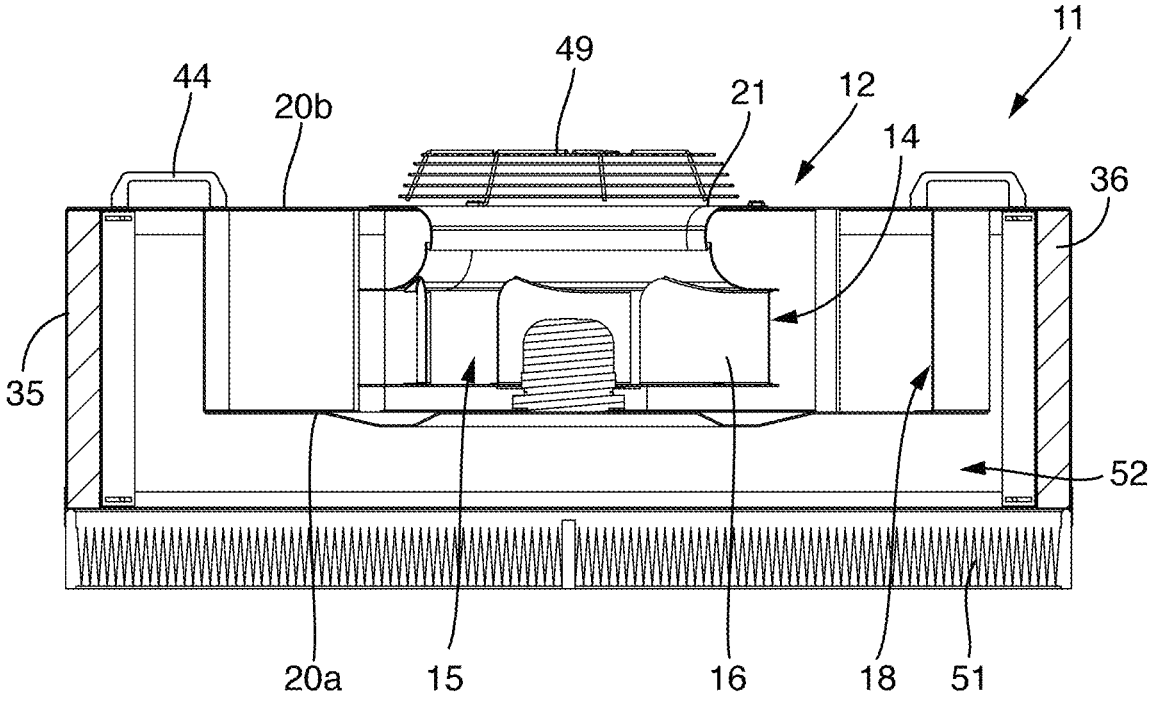

As is particularly shown in FIG. 1 or 2, fastening holes 43 which are arranged in the edge region of the front cover plate 20*b*, in particular at regular distances along the periphery of the front cover plate 20*b*, are provided as fastening means on the front cover plate 20*b*. The fastening holes 43 on the front cover plate 20*b* are brought into flush alignment with fastening holes on the upper edges of the peripheral wall elements 40*a*-40*d*, and the front cover plate 20*b* is screwed onto the upper edge of the frame-like peripheral wall 36 in a simple manner by way of fastening screws 44.

In order to be able to handle the assembly of the radial fan 12 in a simple manner, carrier grips 44 are located on the upper side of the front cover plate 20*b*. In this example case, four carrier grips 44 which are assigned to the respective corners of the front carrier plate 20*b* are provided.

As is particularly shown in FIG. 6, the rear cover plate 20*a* in contrast to the front cover plate 20*b* which forms the rear terminating wall of the outer housing 35 comprises a non-square, in particular irregularly shaped outline area which is adapted to the shape of the arcuately bent base sections 23 of the guide wall elements 22*a-d*.

As is further shown in FIG. 6, stiffening regions 45 are formed on the rear cover plate 20*a* and these ensure that the vibrations which are caused by the impeller 14 are minimised. Usefully, the stiffening regions 45 are circularly round material thickenings in the centre of the rear cover plate 20*a*.

The rear cover plate 20*a* further in particular has a circle-like opening 46, via which an electrical contacting of the impeller is possible. As is particularly shown in FIG. 6, a control device 48 for the activation of the impeller 14 is seated on the outer housing, in particular on the front cover plate which forms the front terminating wall, wherein a contacting takes place by way of a cable which is led between the control device 48 and the impeller 14 via the through-opening 46.

As is particularly shown in FIGS. 1 and 2, the air suction opening 21 is provided with an in particular circularly round grating 48. The sucking of parts which could possibly damage the impeller is prevented by way of this.

As already mentioned, the air blow-out openings 19*a-d* form mouth areas 33 which are aligned at an angle, in particular at an angle of <90°, to an assigned side edge of the front cover pate 20*b*. As is particularly shown in FIG. 6, the rear cover plate 20*a* is therefore arranged in a manner twisted with respect to the front cover plate 20*b*. The oblique arrangement of the mouth areas 33 in the installed state of the assembly of the radial fan ensures that a wedge-shaped air blow-out space 50 is formed for each air blow-out opening 19*a-d*, between the outer surfaces of the guide wall elements 22*a-d* and the inner surfaces of the peripheral wall elements 40*a-d*. Herein, the distance between the mouth area 33 at the respective air blow-out opening 19*a-d* to the corner of the assigned peripheral wall 40*a-d* is greatest.

As already mentioned, the fan device can be applied in clean rooms as a filter fan unit. For this, a fastening interface 52 for fastening a filter element is formed in the region of the rear face-side end of the frame-like peripheral wall. As is particularly shown in FIG. 3, such an air filter is fastened to the fastening interface 52. The air filter in this case is arranged downstream of the rear frame opening considered in the flow direction.

As already mentioned, the assembly of the radial fan which can be handled as a unit, by way of handling the carrier grips 44 can be simply applied onto the upper edges of the frame-like peripheral wall 36 and be connected to the peripheral wall elements 40. Herein, the impeller projects with the rear cover plate 20*a* into the receiving space 42.

On operation, air is sucked axially via the air suction opening 21 and gets into the impeller 14 where it is deflected radially and is blown out radially at the outer diameter of the blade ring 15. The radially blown-out air subsequently gets into a blow-out zone and guided by the guide wall elements is blown out at the air blow-out openings 19*a-d* and then subsequently gets into the wedge-shaped air blow-out spaces 50. The blown-out air is subsequently deflected at the inner side of the peripheral wall 36 and then gets to the outflow opening which is provided with the aforementioned filter element 51. The air is then blown out of the fan device 11 via the filter.

What is claimed is:

1. A fan device with at least one radial fan, with a fan housing in which an impeller, which is rotationally driven about a rotation axis, is arranged, wherein the fan housing comprises a guide wall, which extends in a circumferential direction of the impeller around this, is equipped with several arcuate wall sections and delimits air blow-out openings, wherein an arcuate wall section of the guide wall is assigned to each of the air blow-out openings, wherein the fan housing comprises a front cover plate, which is provided with an air suction opening, and a rear cover plate, which, with regard to the flow direction, is arranged downstream of the front cover plate, and wherein a frame-shaped peripheral wall of an outer housing is arranged around the guide wall and at its rear side comprises a rear frame opening, said rear frame opening being arranged in front of the rear cover plate and serving as an outflow opening, and at its front side comprises a front frame opening, and wherein the front cover plate of the fan housing simultaneously forms a front terminating wall of the outer housing, which projects around and beyond the guide wall and with which the fan housing is fastened to the frame-shaped peripheral wall of the outer housing in the region of the front frame opening at the front side by way of fastening means.

2. A fan device according to claim 1, wherein the front and the rear frame opening have an essentially equally large opening cross section.

3. A fan device according to claim 1, wherein the front cover plate projects around and beyond the opening cross section of the front frame opening and is fastened to the front face edge of the frame-like peripheral wall by way of fastening means.

4. A fan device according to claim 1, wherein the frame-shaped peripheral wall of the outer housing has a rectangular cross section.

5. A fan device according to claim 1, wherein the frame-shaped peripheral wall comprises a plurality of peripheral wall elements, which are connected to one another by way of connection means.

6. A fan device according to claim 1, wherein the front cover plate of the fan housing, which forms the front terminating wall of the outer housing has a larger outline area than the rear cover plate of the fan housing, wherein the outline area of the rear cover plate is smaller than the cross section of the front frame opening to the extent that the radial fan with its fan housing as an assembly able to be handled as a unit is inserted with the rear cover plate in front into a receiving space, which is laterally delimited by the frame-like peripheral wall.

7. A fan device according to claim 1, wherein the front cover plate comprises four carrier grips, which are assigned to the respective corners of the front cover plate.

8. A fan device according to claim 1, wherein the guide wall is fastened by way of guide wall fastening means on the one hand to the front cover plate and on the other hand to the rear cover plate.

9. A fan device according to claim 1, wherein the guide wall is constructed from a plurality of guide wall elements, which form the arcuate wall sections and are designed as separate components.

10. A fan arrangement according to claim 9, wherein the guide wall elements each comprise an arcuately bent base section and web-like fastening sections, which are arranged on the longitudinal edges of the base section, lie opposite one another and each extend in the plane of the cover plates, for fastening to the assigned cover plate.

11. A fan arrangement according to claim 10, wherein front, face-side ends of the base section of the guide wall element, together with the rear face-side ends of the adjacent guide wall element, form lateral delimitations for the air blow-out openings.

12. A fan arrangement according to claim 11, wherein the front face-side ends of the base sections of the guide wall elements comprise a terminating section, which is bent over with respect to the remainder of the base section.

13. A fan device according to claim 1, wherein the web-shaped fastening sections, which are assigned to the front cover plate are fastened to the inner side of the front cover plate in a direct manner or indirectly by way of an intermediately arranged fastening plate, on which on the one hand the fastening sections are fastened and which on the other hand is fastened to the inner side of the front cover plate.

14. A fan device according to claim 1, wherein at least two of the air blow-out openings lie diametrically opposite with regard to the rotation axis of the impeller.

15. A fan device according to claim 1, wherein the air blow-out openings each comprise a mouth area, which is directed at an angle to an assigned side edge of the front cover plate.

16. A fan device according to claim 1, wherein a fastening interface for fastening a filter element is formed in the region of the rear face-side end of the frame-like peripheral wall.

17. A fan device according to claim 16, wherein a filter element is fastened to the fastening interface.

* * * * *